US011776731B2

(12) United States Patent
Hamada et al.

(10) Patent No.: US 11,776,731 B2
(45) Date of Patent: Oct. 3, 2023

(54) REACTOR

(71) Applicant: TAMURA CORPORATION, Tokyo (JP)

(72) Inventors: Tsutomu Hamada, Saitama (JP); Asami Tsushima, Saitama (JP)

(73) Assignee: TAMURA CORPORATION, Tokyo (JP)

( * ) Notice: Subject to any disclaimer, the term of this patent is extended or adjusted under 35 U.S.C. 154(b) by 181 days.

(21) Appl. No.: 17/535,195

(22) Filed: Nov. 24, 2021

(65) Prior Publication Data

US 2022/0181066 A1 Jun. 9, 2022

(30) Foreign Application Priority Data

Dec. 4, 2020 (JP) ..... 2020-201569

(51) Int. Cl.

| | |
|---|---|
| ***H01F 27/24*** | (2006.01) |
| ***H01F 27/26*** | (2006.01) |
| ***H01F 27/28*** | (2006.01) |
| ***H01F 17/06*** | (2006.01) |
| ***H01F 17/04*** | (2006.01) |
| ***H01F 27/25*** | (2006.01) |

(52) U.S. Cl.

CPC ..... *H01F 27/26* (2013.01); *H01F 17/04* (2013.01); *H01F 17/06* (2013.01); *H01F 27/24* (2013.01); *H01F 27/25* (2013.01); *H01F 27/28* (2013.01)

(58) Field of Classification Search

CPC ..... H01F 27/26; H01F 27/28; H01F 27/263; H01F 37/00; H01F 17/062; H01F 27/245; H01F 27/2455; H01F 27/25; H01F 27/255; H01F 27/266; H01F 17/048; H01F 27/062

See application file for complete search history.

(56) References Cited

U.S. PATENT DOCUMENTS

| | | | | |
|---|---|---|---|---|
| 9,281,117 | B2 * | 3/2016 | Dai | H01F 3/10 |
| 2009/0027151 | A1 | 1/2009 | Nakatsu et al. | |
| 2011/0169598 | A1 | 7/2011 | Nakatsu et al. | |
| 2015/0069853 | A1 * | 3/2015 | Wang | H02M 1/14 307/104 |
| 2021/0407725 | A1 * | 12/2021 | Inaba | H01F 3/08 |

FOREIGN PATENT DOCUMENTS

| | | | | |
|---|---|---|---|---|
| JP | 4751266 | | 5/2011 | |
| JP | 2018133461 | A * | 8/2018 | H01F 27/255 |

* cited by examiner

*Primary Examiner* — Tuyen T Nguyen

(74) *Attorney, Agent, or Firm* — SNELL & WILMER LLP

(57) ABSTRACT

Downsized and weight reduced reactor is provided. An annular core 3 includes a first leg 31 and a second leg 32 to which a coil 2 is mounted and which generates magnetic flux, and a pair of yokes 33 which form a closed magnetic path together with the legs. Recess portions 35*a* is formed at four corners of the annular core 3, and a part of the end surfaces 31*a* and 32*a* of the legs which is a magnetic flux generating part or an end surface of the magnetic flux generating part is exposed from the recess portion 35*a*.

10 Claims, 6 Drawing Sheets

REACTOR

CROSS-REFERENCE TO RELATED APPLICATION

This application is based upon and claims the benefit of priority from Japan Patent Application No. 2020-201569, filed on Dec. 4, 2020, the entire contents of which are incorporated herein by reference.

FIELD OF INVENTION

The present disclosure relates to a reactor having a core and a coil.

BACKGROUND

Reactors have a coil and a core. In order to achieve electrical insulation between the coil and the core, generally, the core is covered by resin, and the wound coil is attached to the resin on the core. The reactor is a passive element that converts electric energy into magnetic energy, and stores and releases said energy.

Such reactors are used in various applications. Typical reactors may be boost reactors incorporated in an automotive voltage multiplier circuit such as the drive system of hybrid and electric vehicles As integration of electronic and electrical components advances, downsizing and weight reduction of these components are demanded. Of course, performance of the components must not be reduced in exchange for downsizing and weight reduction. Therefore, for example, as indicated in Patent Document 1, a reactor that removes a portion of an annular core through which almost no magnetic flux passes has been proposed.

The annular core of the reactor is a single annular structure formed by two coil-mounted core arranged in parallel to each other and two yokes arranged at both sides of the two coil-mounted cores. Magnetic flux passing through two corners of the yoke far from the coil-mounted cores is very small. Therefore, in conventional reactors, two corners of the yoke far from the coil-mounted core are cut off to the extent end surfaces of the coil-mounted cores are not exposed. Since the cut portion is where the magnetic flux hardly passes through, the performance of the reactor does not deteriorate.

PRIOR ART DOCUMENT

Patent Document

Patent Document 1: JP 4751266

SUMMARY OF INVENTION

Problems to be Solved by Invention

In recent years, integration of electronic components has further advanced, and further downsizing and weight reduction of electronic and electrical components are demanded. Therefore, it is expected to achieve further downsizing and weight reduction of the reactor by creating more space in the reactor and placing the components of the reactor and external components in this space.

The present disclosure was made in order to solve the above-mentioned problems, and the purpose of the present disclosure is to provide a downsized and weight reduced reactor

Means to Solve the Problem

A reactor according to the present disclosure includes:

an annular core; and a coil, in which:

the annular core includes:

two or more legs to which the coil is mounted and which generates magnetic flux;

a pair of yokes which are arranged separately on both end surfaces of the legs and which form a closed magnetic path together with the legs; and recess portions formed at four corners of the annular core, and a part of the end surfaces of the legs connected to the yoke is exposed from the recess portion.

An inner surface of the yoke may form an inner circumferential surface of the annular core and may be connected the legs, and the part of the end surfaces of the legs exposed from the recess portion may be on a substantially same plane as the inner surface of the yoke.

An overall length of the yoke along a direction in which the legs line up may be shorter than a distance from an outermost of the end surface of one of the legs among two outermost legs positioned at an outermost of the annular core to an outermost of the end surface of the other of the legs among the two outermost legs. A part of the end surface of the two outermost legs may expose from an end surface of the yokes, and the recess portions may be defined by the end surface of the yokes, and a region of the end surface of the two outermost legs exposing from the yokes.

The present disclosure may include a joining layer which is formed by adhesive and which joins the end surface of the two outermost legs, and the yokes.

5 to 30% of the end surface of the two outermost legs may be exposed from the yokes.

When current of 200 A or more is applied to the reactor, 60 to 75% of the end surface of the two outermost legs may exposed from the yokes. In addition, when current of 250 A or more is applied to the reactor, 45 to 75% of the end surface of the two outermost legs may exposed from the yokes

Effect of Invention

According to the present disclosure, by forming the recess portion at portions where an effect to the inductance value of the annular core is small, the downsizing and weight reduction of the reactor can be achieved without reducing the performance of the reactor in the large current range.

EMBODIMENTS

In below, a reactor according to an embodiment of the present disclosure is described with the reference to figures. In order to facilitate understanding of the present disclosure, thickness, dimension, positional relationship, ratio, or shape may be emphasized in each drawing, however, the present disclosure is not limited to the emphasis.

First Embodiment

Figure 1:
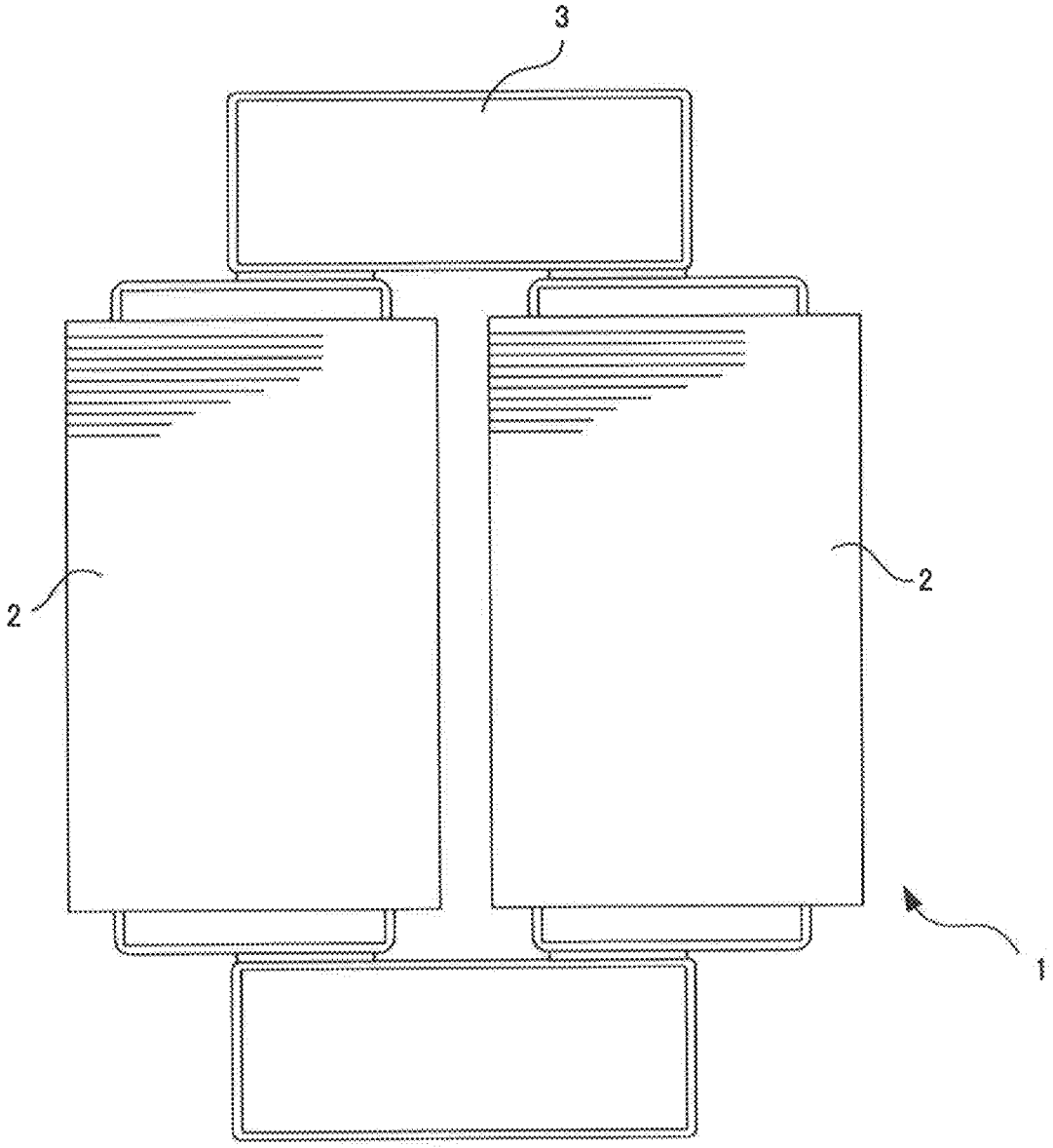
FIG. 1 is plan view illustrating a main configuration of a reactor according to a first embodiment.

FIG. 1 illustrates a main configuration of a reactor. As illustrated in FIG. 1, a reactor 1 of the first embodiment includes two coils 2 and an annular core 3. Two coils 2 are mounted on the annular core 3. When current flows in the coil 22, the coil 2 generates magnetic flux according to the number of turns, such that the annular core 3 becomes a closed magnetic path through which the magnetic flux passes according to magnetic permeability higher than a vacuum. That is, the reactor 1 is a passive element that converts electric energy into magnetic energy, and stores and releases said energy.

The coil 2 is a cylindrical winding of a conductive wire such as a copper wire and is formed by spirally winding the conductive wire while displacing the winding position along a winding axis for each turn. Two coils 2 are connected in parallel or in series by bus bars, etc.

The annular core 3 is a magnetic body such as a dust core, a ferrite core, a metal composite core, or a laminated steel plate. The dust core is formed by annealing pressed compacted magnetic powder. The magnetic powder includes iron powder as a main component, and may be pure iron, permalloy (Fe—Ni alloy) including iron as a main component, Si-containing iron alloy (Fe—Si alloy), sendust alloy (Fe—Si—Al alloy), amorphous alloy, nanocrystalline alloy powder, or a mixture of two or more thereof. The metal composite core is a core formed by kneading the magnetic powder and resins.

Figure 2:
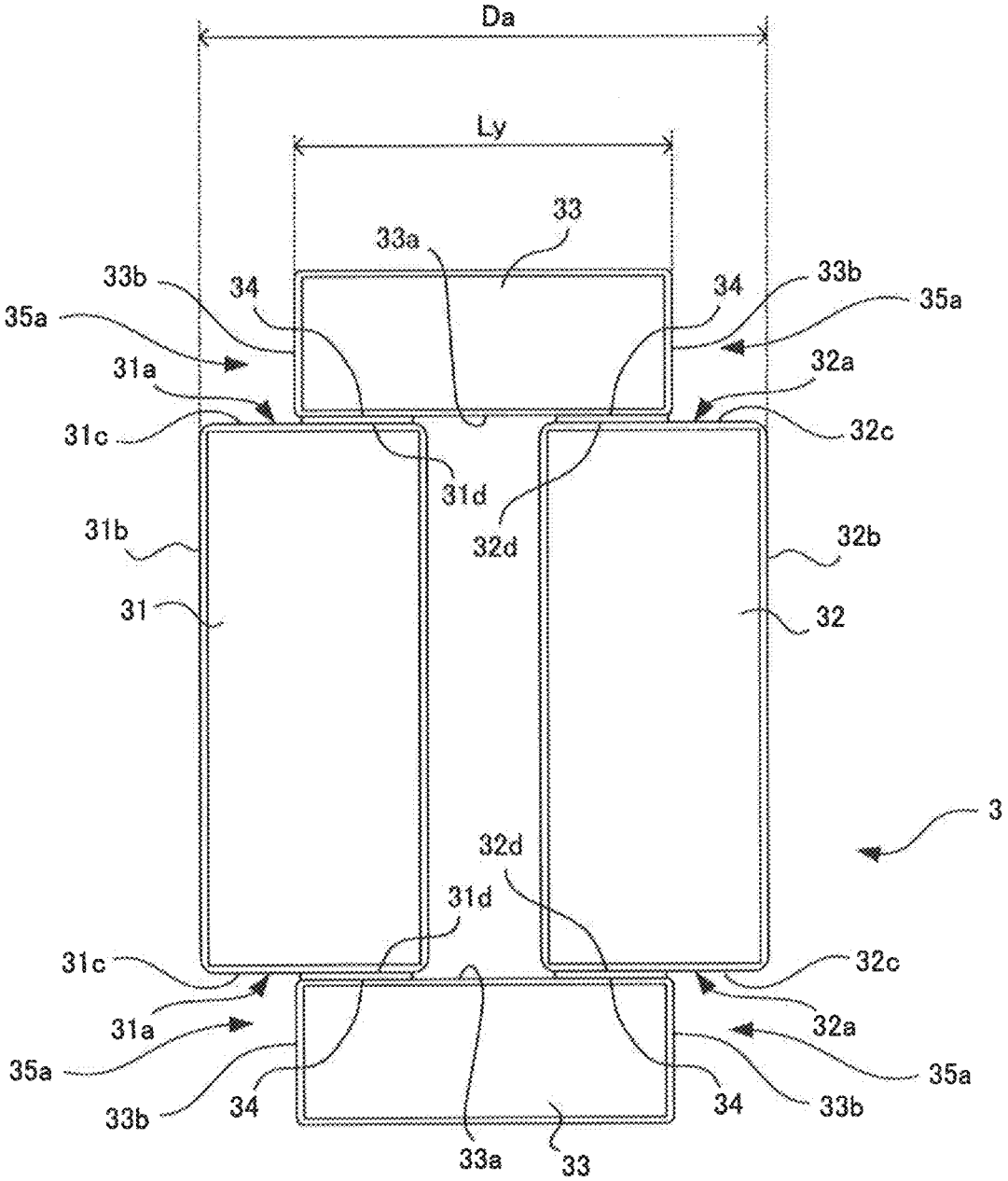
FIG. 2 is a plan view illustrating a configuration of an annular core according to the first embodiment.

FIG. 2 is a plan view illustrating a detailed configuration of the annular core 3 according to the first embodiment. As illustrated in FIG. 2, the annular core 3 includes a first leg 31, a second leg 32, and a pair of yokes 33. The first leg 31, the second leg 32, and a pair of yokes 33 are combined to form one annular closed magnetic path. The first leg 31 and the second leg 32 are fit into the coil 2 (refer FIG. 1) and generate magnetic flux. The pair of yokes connect the first leg 31 and the second leg 32 are connected by the magnetic flux.

The first leg 31, the second leg 32, and the pair of yokes 33 are each formed by quadrangular prismatic I-shaped cores which are linearly extended. Gaps may be formed in the first leg 31 and the second leg 32. If the gap is formed, the first leg 31 and the second leg 32 may be formed by a series of short I-shaped cores, and the gap is provided between the short I-shaped cores. The gap is a magnetic gap in which the magnetic permeability thereof is extremely lower than the annular core 3 and is a tabular spacer such as ceramic or an air gap.

The first leg 31 and the second leg 32 are arranged in parallel with each other. Hereafter, the direction to which the first leg 31 and the second leg 32 extend is referred to as the vertical direction. The direction to which the first leg 31 and the second leg 32 are lined up is called the horizontal direction, and the pair of yokes 33 are arranged in parallel with each other and extends along the horizontal direction. The horizontal direction is orthogonal to the vertical direction. The pair of yokes 33 are arranged to sandwich the first leg 31 and the second leg 32 at both end portions. Furthermore, an end surface 31*a* of the first leg 31 is abut and joined with an inner surface 33*a* of the yokes 33 in the annular core 3. An end surface 32*a* of the second leg 32 is abut and joined with the inner surface 33*a* of the yokes 33 in the annular core 3.

As described above, the annular core 3 forms a closed ring. Among six surfaces of the first leg 31 and the second leg 32, the end surface 31*a* of the first leg 31 and the end surface 32*a* of the second leg 32 expand orthogonally to the vertical direction. The inner surface 33*a* of the yokes 33 face the end surface 31*a* of the first leg 31 and the end surface 32*a* of the second leg 32.

The first leg 31 is joined to the yokes 33 by adhesives, and the second leg 32 is joined to the yokes 33 by adhesives. Therefore, joining layers 34 formed by the adhesives are provided between the first leg 31 and the yokes 33 and between the second leg 32 and the yokes 33. The joining layers 34 act as air gaps according to the thickness of the joining layers 34.

An overall length Ly of the yoke 33 is shorter than a distance Da between the first leg 31 and the second leg 32. The overall length Ly of the yoke 33 is a length along the horizontal direction. The distance Da between the first leg 31 and the second leg 32 is a distance along the horizontal direction and is a separation distance from an outer end portion of the end surface 31*a* of the first leg 31 to the outer end portion of the end surface 32*a* of the second leg 32. The distance Da includes the full length of end surface 31*a* of the first leg 31 and the full length of the end surface 32*a* of the second leg 32.

The end surface 31*a* of the first leg 31 and the end surface 32*a* of the second leg 32 are divided into exposed regions 31*c* and 32*c* and joined regions 31*d* and 32*d*. The exposed regions 31*c* and 32*c* protrude out and are exposed from the yoke 33. The joined regions 31*d* and 32*d* are joined to the inner surface 33*a* of the yokes 33 via the joining layers 34. The end surface 33*b* of the yokes 33 is positioned deeper in the horizontal direction than an outer face 31*b* of the first leg 31 and an outer face 32*b* of the second leg 32. The end surface 33*b* of the yokes 33 are a surface that expand orthogonal to the horizontal direction. The outer surface 31*b* of the first leg 31 and the outer surface face 32*b* of the second leg 32 expand along the vertical direction and is away from a center of the core 3.

Recess portions 35*a* are formed in each four corners of the annular core 3. Two of the four recess portions 35*a* are sectioned by the exposed region 31*c* of the end surface 31*a* of the first leg 31 and the end surface 33*b* of the yokes 33. Other two of the four recess portions 35*a* are sectioned by the exposed region 32*c* of the end surface 32*a* of the second leg 32 and the end surface 33*b* of the yokes 33.

The exposed region 31*c* of the end surface 31*a* of the first leg 31 and the inner surface 33*a* of the yokes 33 are on the same plane, except for the joining layer 34. The exposed region 32*c* of the end surface 32*a* of the second leg 32 and the inner surface 33*a* of the yokes 33 are on the same plane, except for the joining layer 34. In other words, the magnetic path which the magnetic flux generated nearby the end surface 31*a* and the end surface 32*a* can pass through is not formed in the annular core 3.

The ratio of the width of the exposed regions 31*c* and 32*c* in the horizontal direction relative to the width of the end surfaces 31*a* and 32*a* in the horizontal direction is preferably equal to or more than 5% and equal to or less than 30%. Within this range, the inductance value does not drop in the entire current range, or the inductance value may drop within 5% in the range of 100 A or less, compared with when the recess portions 35*a* are formed.

When current of 200 A or more is applied to the reactor 1, the ratio of the width of the exposed regions 31*c* and 32*c* in the horizontal direction relative to the width of the end surfaces 31*a* and 32*a* in the horizontal direction may be 60% to 75%. Within this range, the inductance value when current of 200 A or more is applied is improved compared with when the recess portions 35*a* are not formed. When a current of 250 A or more is supplied to the reactor 1, the percentage of the width of the exposed regions 31*c* and 32*c* to the width of the end surfaces 31*a* and 32*a* may be between 45% and 75%. Within this range, the inductance value when a current of 250 A or more is supplied is improved compared to the case where the recesses 35*a* are not formed. However, even outside this range, the inductance value equivalent to that without the recess portions 35*a* can be obtained.

Figure 3:
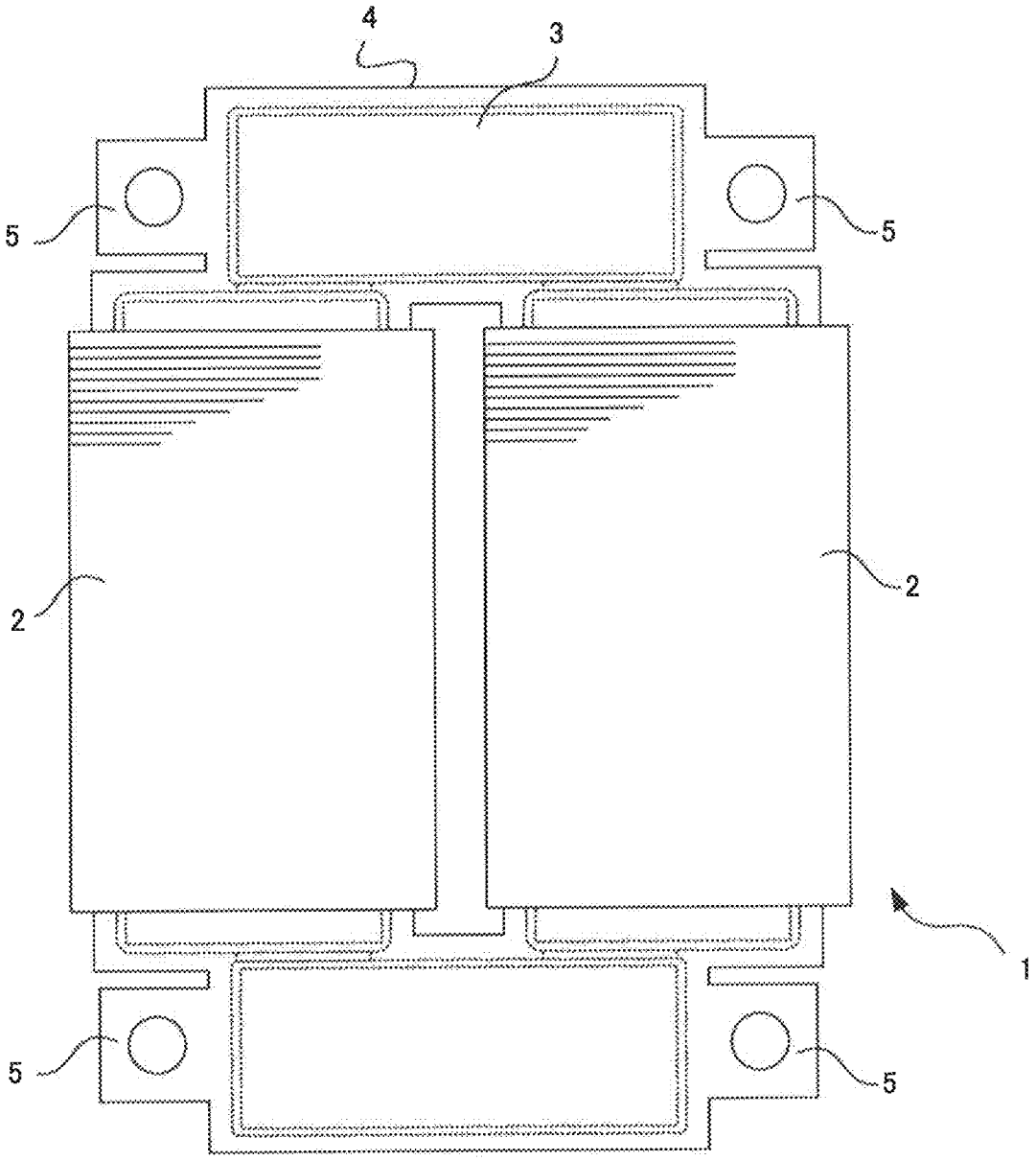
FIG. 3 is a plan illustrating an entire configuration of the reactor according to the first embodiment

FIG. 3 is a plan view of the entire configuration of the reactor 1. The reactor 1 further includes a core-coating resin 4. The core-coating resin 4 is coated on the annular core 3. The coils 2 are mounted on this core-coating resin 4 and are electrically insulated from the annular core 3.

The core-coating resin 4 is a resin-molded component and has insulation and heat-resistant properties. The material of the core-coating resin 4 is, for example, epoxy resin, unsaturated polyester-based resin, urethane resin, BMC (Bulk Molding Compound), PPS (Polyphenylene Sulfide), PBT (Polybutylene Terephthalate), or composites thereof.

Fastening members 5 for fastening the reactor body 1*a* to other components is formed in the core-coating resin 4. A reactor body 1*a* includes the coils 2, the annular core 3, and the core-coating resin 4. For example, the reactor body 1*a* is fastened to the bathtub-shaped metal casing to house the reactor body 1*a* using fastening members 5. The fastening members 5 includes bolt holes that align with bolt holes in support components such as the metal casing, and bolts are inserted into the bolt holes. For example, the fastening members 5 is the components installed on the recess portions 35*a* formed at four corners of the annular core 3.

In the reactor 1, a part of the end surface 31*a* of the first leg 31 and a part of the end surface 32*a* of the second leg 32 are exposed in the recess portions 35*a*. The first leg 31 and the second leg 32 are magnetic flux generating portion on which the coils 2 are wound. The end surface 31*a* of the first leg 31 and the end surface 32*a* of the second leg 32 have no distance or have little distance from the end portion of the coils 2.

The exposed region 31*c* of the end surfaces 31*a* of the first leg 31 and the inner surface 33*a* of the yokes 33 line up on the same plane except for the joining layers 34. The exposed region 32*c* of the end surface 32*a* of the second leg 32 and the inner surface 33*a* of the yokes 33 line up in the same plane except for the joining layer 34. For the above reasons, the magnetic path which the magnetic flux generated nearby the end surface 31*a* and the end surface 32*a* can pass through is not formed in the annular core 3.

The reason is because the magnetic flux generated nearby the exposed region 31*c* of the first leg 31 and the exposed region 32*c* of the second leg 32 cannot turn at an angle close to a right angle relative to the axis of the coil 2, and cannot penetrate the joined region 31*d* and 32*d*. Therefore, the magnetic flux generated nearby the exposed regions 31*c* and 32*c* passes through the exposed regions 31*c* and 32*c*, leaks into the recess portions 35*a*, and then enters the end surface 33*b* of the yokes 33.

The exposed region 31*c* of the first leg 31 is adjacent to the joined region 31*d*, the exposed region 32*c* of the second leg 32 is adjacent to the joined region 32*d*, and the joined regions 31*d* and 32*d* are joined to the yoke 33. In the joined regions 31*d* and 32*d*, there is the joining layer 34 with high magnetoresistance. Since high magnetoresistance of the joining layer 34 suppresses the magnetic flux passing through the joined regions 31*d* and 32*d*, more magnetic flux passes through the exposed regions 31*c* and 32*c*, leaks into the recess 3 portion 5, and then enters the end surface 33*b* of the yokes 33.

Since the recess portions 35*a* act as an air gap, the recess portions 35*a* can be used as a space for installing components such as the fastening member 5 in the reactor 1 without largely affecting the inductance value in the large current region.

Figure 4:
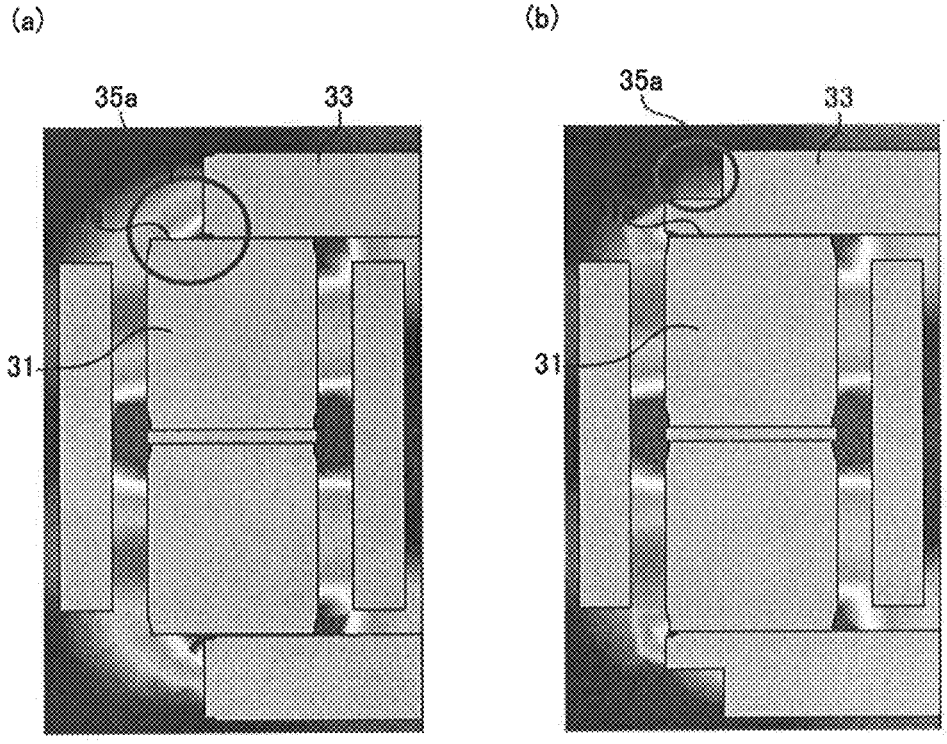
FIG. 4 is a diagram illustrating a magnetic flux distribution state outside the reactor of the first embodiment and a comparative reactor observed by simulation.

FIG. 4(*a*) is a diagram illustrating a magnetic flux distribution state outside the reactor observed by simulation, and FIG. 4(*b*) is a diagram illustrating a magnetic flux distribution state outside a comparative reactor observed by simulation. The comparative reactor includes recess portions 35*a* at corners of the annular core 3. However, the depth of the recess portions 35*a* of the comparative reactor in the vertical direction is shallower than the vertical length of the yokes 33. Therefore, the recess portions 35*a* of the comparative reactor are provided at two of the four corners of the yoke 33 corresponding to the corners of the reactor 1, and are not provided at a side of the end surfaces 31*a* of the first leg 31 and a side of the end surfaces 32*a* of the second leg 32.

In FIG. 4, the circled area is the recess portion 35*a*. As can be seen by comparing FIGS. 4(*a*) and 4(*b*), it can be observed that, in the reactor 1 of the present embodiment, the magnetic flux is leaking from the recess portion 35*a*. In contrast, it can be observed that, in the comparative reactor, the magnetic flux is hardly leaking out from the recess portion 35*a*. That is, it can be observed that the recess portion 35*a* acts as an air gap. In addition, it can be seen that the recess portion 35*a* does not significantly affect the inductance value in the large current region, and provides space for installing components such as the fastening member 5 in the reactor 1.

Next, the relationship between the current and the inductance value in the reactor 1 of the first embodiment is shown in Table 1. In Example 1, the ratio of the exposed regions 31*c* and 32*c* relative to the reactor is 5%, in Example 2, the ratio of the exposed regions 31*c* and 32*c* relative to the reactor is 15%, in Example 3, the ratio of the exposed regions 31*c* and 32*c* relative to the reactor is 30%, in Example 4, the ratio of the exposed regions 31*c* and 32*c* relative to the reactor is 45%, in Example 5, the ratio of the exposed regions 31*c* and 32*c* relative to the reactor is 60%, and in Example 6, the ratio of the exposed regions 31*c* and 32*c* relative to the reactor is 75%. In Comparative Example 1, the ratio of the exposed regions 31*c* and 32*c* relative to the reactor is 0%, and in Comparative Example 2, the ratio of the exposed regions 31*c* and 32*c* relative to the reactor is 100%. Current up to 250 A was applied to the reactor 1 of Examples 1 to 6 and the reactor of Comparative Examples 1 and 2, respectively, and the inductance values were measured. In the reactor 1 of Examples 1 to 6, the entire width of the end surfaces 31*a* and 31*b* in the horizontal direction was 13.5 mm. In Comparative Examples 1 and 2, the entire width of the end surfaces was 13.5 mm.

TABLE 1

| | | Comparative Example 1 | Example 1 | Example 2 | Example 3 | Example 4 | Example 5 | Example 6 | Comparative Example 2 |
|---|---|---|---|---|---|---|---|---|---|
| Ratio of Exposed Region | | 0% | 5% | 15% | 30% | 45% | 60% | 75% | 100% |
| Current I(A) | 0 | 43.9 | 43.7 | 43.1 | 41.8 | 39.9 | 37.0 | 32.3 | 17.6 |
| | 100 | 24.4 | 24.3 | 24.1 | 23.5 | 22.5 | 21.0 | 19.5 | 17.4 |
| | 150 | 17.7 | 17.7 | 17.6 | 17.3 | 16.9 | 16.6 | 16.6 | 16.7 |
| | 200 | 13.8 | 13.9 | 13.8 | 13.8 | 13.8 | 14.1 | 14.6 | 15.6 |
| | 250 | 11.3 | 11.3 | 11.3 | 11.3 | 11.6 | 12.1 | 12.9 | 14.4 |

In Table 1, the ratio of the exposed regions 31*c* and 32*c* is a ratio of the width of the exposed regions 31*c* and 32*c* in the horizontal direction relative to the width of the end surfaces 31*a* and 32*a*. The ratio of exposed region 31*c* and the ratio of the exposed region 32*c* are the same. The ratio of the exposed regions 31*c* and 32*c* is 0%, meaning that the recess portions 35*a* are not formed, and the ratio of the exposed regions 31*c* and 32*c* is 100%, meaning that only the corner of the first leg 31 and the corner of the yoke 33 are in contact with each other, and only the corner of the second leg 32 and the corner of the yoke 33 are in contact with each other.

Furthermore, based on values in Table 1, Table 2 shows the ratio of decreased inductance values of Examples 1 to 6 relative to the inductance values of Comparative Example 1. In Table 2, positive values indicate that the inductance values of Examples are lower than that of Comparative Example 1, and negative values indicate that the inductance values of Examples are higher than that of Comparative Example 1.

TABLE 2

| | | Comperaitve Example 1 | Example 1 | Example 2 | Example 3 | Example 4 | Example 5 | Example 6 | Comparative Example 2 |
|---|---|---|---|---|---|---|---|---|---|
| Ratio of Exposed Region | | 0% | 5% | 15% | 30% | 45% | 60% | 75% | 100% |
| Current I(A) | 0 | 0% | 1% | 2% | 5% | 9% | 16% | 26% | 60% |
| | 100 | 0% | 0% | 1% | 4% | 8% | 14% | 20% | 29% |
| | 150 | 0% | 0% | 1% | 2% | 5% | 6% | 6% | 6% |
| | 200 | 0% | 0% | 0% | 1% | 1% | −1% | −5% | −13% |
| | 250 | 0% | 0% | 0% | 0% | −1% | −7% | −14% | −27% |

As shown in Table 1 and Table 2, the initial inductance values of Examples 1 to 6, in which the ratio of the exposed regions 31*c* and 32*c* is 5 to 75%, are lower than those of Comparative Example 1, in which the ratio of the exposed regions 31*c* and 32*c* is 0%. The initial inductance value is a value when there is no DC current superimposition. The initial inductance value drops because the recess portions 35*a* are present in the magnetic path through which the magnetic flux passes. The initial inductance value drops as the ratio of the exposed regions 31*c* and 32*c* increases, because the portion of the core through which the magnetic flux passes is greatly reduced.

Compared with Comparative Example 1 in which the ratio of the exposed regions 31*c* and 32*c* is 0%, the inductance values for Examples 1 to 3 in which the ratio of the exposed regions 31*c* and 32*c* is 5 to 30% does not decrease in the entire current range including zero DC current superimposition. Even if there is reduction in the inductance value, it can be observed that the reduction in the inductance value is within 5% in the range of 100 A or less.

When current of 150 A is applied to the reactor 1, similarly to Examples 1 to 3, the reactor 1 of Examples 4 to 6, in which the ratio of the exposed regions 31*c* and 32*c* is 45% or more, reduces the reduction ratio in the inductance value of one digit compared to the reactor of Comparative Example 1. When current of 200 A or more is applied to the reactor 1, the inductance values of the reactor 1 of Examples 1 to 6 are almost the same as or higher than the inductance value of the reactor of Comparative Example 1.

That is, it can be observed that the recess portions 35*a* formed to expose a part of the end surface 31*a* of the first leg 31 and the end surface 32*a* of the second leg 32 act as an air gap and has little effect on the inductance value in the large current range. Therefore, by forming the recess portions 35*a* to expose a part of the end surface 31*a* of the first leg 31 and the end surface 32*a* of the second leg 32 which are magnetic flux generating parts, large spacing can be obtained without reducing the performance of the reactor 1 in the large current range, and the downsizing and weight reduction of the reactor 1 can be achieved.

When current of 200 A or more is applied to the reactor 1, the inductance values of the reactors 1 of Examples 5 and 6, in which the ratio of the exposed regions 31*c* and 32*c* is 60% to 75%, are higher than those of the reactor of Comparative Example 1. When current of 250 A or more is applied to the reactor 1, the inductance values of the reactors 1 of Examples 4 to 6, in which the ratio of exposed regions 31*c* and 32*c* is 45% to 75%, are higher than those of the reactor of Comparative Example 1. This indicates that the performance of the reactor 1 with the recess portions 35*a* improves, depending on the size of the recess portions 35*a* and the degree of large current applied to the reactor.

Comparative Example 2, in which the ratio of the exposed regions 31*c* and 32*c* is 100%, has the same level of inductance value as the Examples 1 to 6 in the large current range, however, the initial inductance value thereof is much smaller than Examples 1 to 6.

Note that, since the reactor 1 formed as such includes the yokes 33, the first leg 31, and the second leg 32, all of which are quadrangular prismatic I-shaped core, the productivity of the reactor 1 is excellent and the production cost of the reactor 1 can be reduced.

Second Embodiment

Figure 5:
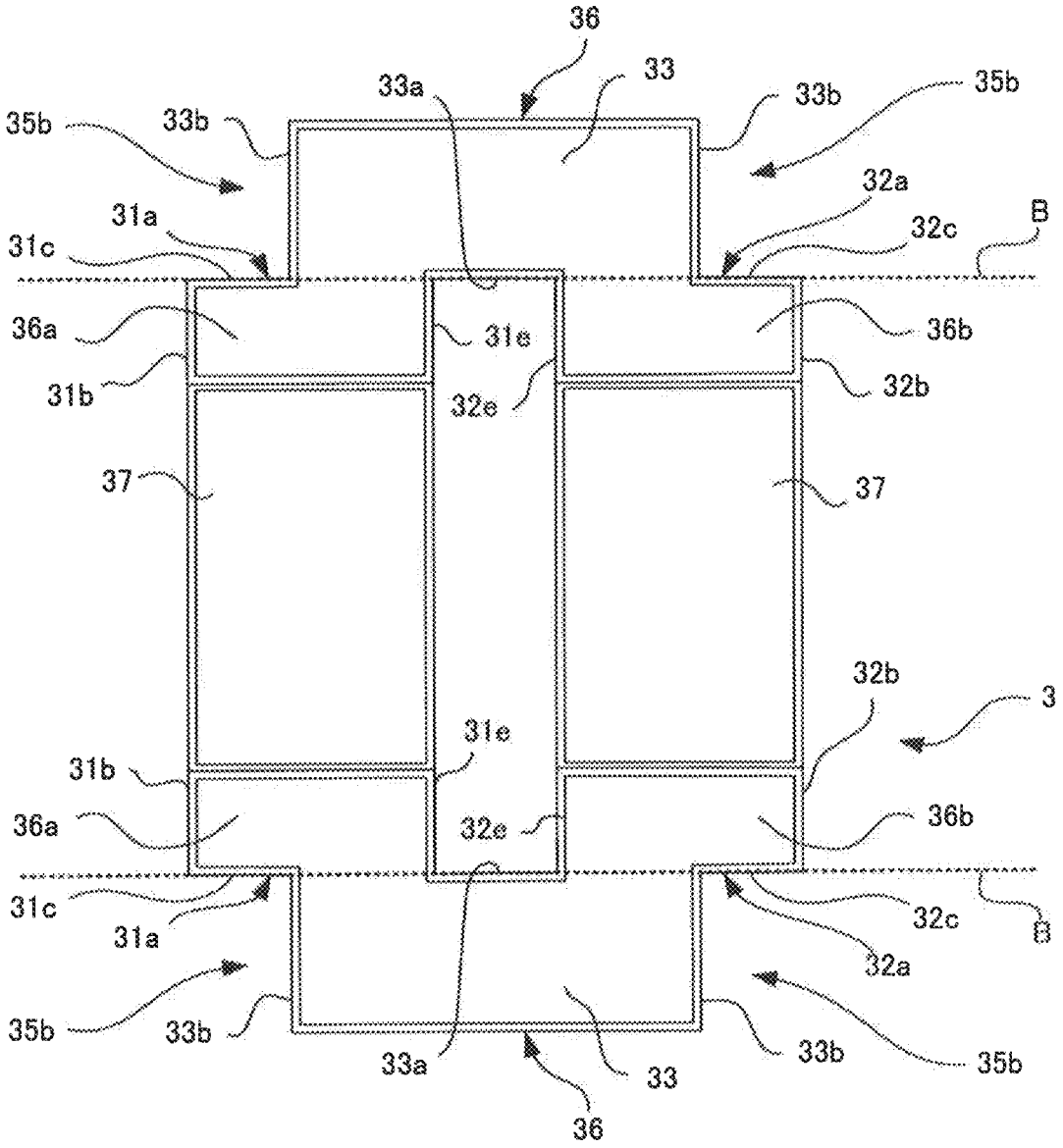
FIG. 5 is a plan view illustrating a configuration of an annular core according to a second embodiment

FIG. 5 is a plan view illustrating a detailed configuration of an annular core 3 according to the second embodiment.

As illustrated in FIG. 5, the annular core 3 includes a pair of U-shaped blocks 36 and two leg blocks 37. In the U-shaped blocks 36, the legs 36*a* and 36*b* are protruding from both ends of the inner surface 33*a* of the yoke 33 to form U-shape. The pair of U-shaped blocks 36 are placed to face each other so that the legs 36*a* and 36*a* face each other, and a leg block 37 is placed between the legs 36*a* and between the legs 36*b*. As a result, the annular core 3 has a ring-shaped closed magnetic path.

The leg 36*a* and leg 36*b* of the U-shaped block 36 are covered by the end portion of the coil 2. Therefore, the leg 36*a* of the U-shaped block 36 is a part of the magnetic flux generating part and acts as the end side of the first leg 31, and the leg 36*b* of the U-shaped block 36 is a part of the magnetic flux generating part and acts as the end side of the second leg 32.

Both corners of the U-shaped block 36 are cut to form the recess portions 35*b*. The recess portions 35*b* extends to the boundary B between the yoke 33 and the leg 36*a*, and the boundary B between the yoke 33 and the leg 36*b*. That is, the end surface 31*a* of leg 36*a* and the end surface 32*a* of leg 36*b* have exposed regions 31*c* and 32*c* exposed in the recess portions 35*b*. The exposed region 31*c* of the end surface 31*a* of the leg 36*a* and the inner surface 33*a* of the yoke 33 are line up in the same plane, and the exposed region 32*c* of the end surface 32*a* of the leg 36*b* and the inner surface 33*a* of the yoke 33 line in the same plane. In other word, in the annular core 3, there is no magnetic path through which the magnetic flux generated nearby the end surface 31*a* and end surface 32*a* can pass.

The recess portion 35*b* does not reach the plane extending from the inner surface 31*e* of leg 36*a* and the plane extending from the inner surface 32*e* of leg 36*b*. Note that the inner surfaces 31*e* and 32*e* are surface opposite outer surfaces 31*b* and 32*b*.

In the reactor of the second embodiment, the legs 36*a* and the yoke 33 are joined seamlessly, and there is no joining layer 34 adjacent the exposed region 31*c*. In addition, the legs 36*b* and the yoke 33 are joined seamlessly, and there is no joining layer 34 adjacent the exposed region 32*c*.

However, also in the reactor 1, the recess portions 35*b* are exposed from the end surfaces 31*a* and 32*a* of the legs 36*a* and 36*b*, which are the end portions of the magnetic flux generating parts. The exposed region 31*c* of the end surface 31*a* of the leg 36*a* and the inner surface 33*a* of the yoke 33 line up in the same plane, and the exposed region 32*c* of the end surface 32*a* of the leg 36*b* and the inner surface 33*a* of the yoke 33 line up in the same plane.

Therefore, the magnetic flux generated nearby the exposed regions 31*c* and 32*c* cannot turn at an angle close to a right angle relative to the axis of the coil 2, to reach the yoke 33, and the magnetic flux leaks into the recess portions 35*b* from the exposed region 31*c* of the first leg 31 and the exposed region 32*c* of the second leg 32 and enters the end surface 33*b* of the yoke 33.

Accordingly, also in the reactor 1, the recess portions 35*b* act as an air gap. Therefore, in the recess portions 35*b*, the effect relative to the inductance value in the large current range is small, and the recess portions 35*b* can be used as a spacing for placing components such as the fastening member 5 inside the reactor 1, without reducing the performance of the reactor 1.

The reactors 1 of Examples 7 to 11, in which the recess portions 35*b* are formed in the U-shaped blocks 36 and in which the exposed regions 31*c* and 32*c* has the following ratio is prepared. In the reactors 1 of Examples 7 to 11, the yoke 33, and the legs 36*a* and 36*b* are seamlessly formed as one piece. That is, the reactors 1 of examples 7 to 11 are the reactor 1 of the second embodiment. The reactors of Comparative Examples 3 and 4, in which the annular core 3 is formed by the U-shaped block 36, and in which the ratio of the exposed portions 31*c* and 32*c* are 0% and 100%, are prepared.

Current up to 250 A are applied to the reactors of Examples 7 to 11 and Comparative Examples 3 and 4, and the inductance values are measured. The results are shown in Table 3.

TABLE 3

| | | Comparative Example 3 | Example 7 | Example 8 | Example 9 | Example 10 | Example 11 | Comparative Example 4 |
|---|---|---|---|---|---|---|---|---|
| Ratio of Exposed Region | | 0% | 15% | 30% | 45% | 60% | 75% | 100% |
| Current I(A) | 0 | 42.1 | 41.9 | 41.4 | 40.6 | 39.4 | 37.5 | 29.2 |
| | 100 | 24.9 | 24.6 | 24.0 | 22.9 | 20.9 | 18.2 | 16.7 |
| | 150 | 18.1 | 17.8 | 17.4 | 16.6 | 15.5 | 15.3 | 15.5 |
| | 200 | 14.0 | 13.8 | 13.5 | 13.1 | 13.1 | 13.7 | 14.5 |
| | 250 | 11.2 | 11.1 | 10.9 | 10.9 | 11.4 | 12.2 | 13.3 |

Based on values in Table 3, Table 4 shows the ratio of decreased inductance values of Examples 7 to 11 relative to the inductance values of Comparative Example 3. In Table 4, positive values indicate that the inductance values of Examples are lower than that of Comparative Example 3, and negative values indicate that the inductance values of Examples are higher than that of Comparative Example 3.

TABLE 4

| | | Comparative Example 3 | Example 7 | Example 8 | Example 9 | Example 10 | Example 11 | Comparative Example 4 |
|---|---|---|---|---|---|---|---|---|
| Ratio of Exposed Region | | 0% | 15% | 30% | 45% | 60% | 75% | 100% |
| Current I(A) | 0 | 0% | 1% | 2% | 4% | 6% | 11% | 31% |
| | 100 | 0% | 1% | 4% | 8% | 16% | 27% | 33% |
| | 150 | 0% | 1% | 4% | 8% | 14% | 16% | 14% |
| | 200 | 0% | 1% | 3% | 6% | 6% | 2% | −4% |
| | 250 | 0% | 1% | 2% | 3% | −2% | −9% | −19% |

As shown in Table 3 and Table 4, the initial inductance values of Examples 7 to 11, in which the ratio of the exposed regions 31*c* and 32*c* is 15 to 75%, are lower than those of Comparative Example 3, in which the ratio of the exposed regions 31*c* and 32*c* is 0%. However, compared with Comparative Example 3 in which the ratio of the exposed regions 31*c* and 32*c* is 0%, the inductance values for Examples 7 and 8 in which the ratio of the exposed regions 31*c* and 32*c* is less than 30% does not decrease in the entire current range including zero DC current superimposition. Even if there is reduction in the inductance value, it can be observed that the reduction in the inductance value is within 4% in the range of 100 A or less.

When current of 200 A is applied to the reactor 1, it can be observed that Examples 7 and 8 and Examples 9 to 11, in which the ratio of the exposed regions 31*c* and 32*c* is 45% or more, reduces the reduction ratio in the inductance value of one digit compared to the reactor of Comparative Example 3. Also, when current of 250 A or more is applied to the reactor 1, the inductance values of the reactor 1 of Examples 7 to 11 are almost the same as or higher than the inductance value of the reactor of Comparative Example 3.

Furthermore, when current of 250 A or more is applied to the reactor 1, it can be observed that the inductance values of the reactor 1 of Examples 10 and 11 are
Higher than the reactor of Comparative Example 3. That is, it is indicated that even for the reactor 1 of the second embodiment, when the recess portions 35*b* are produced, the performance of the reactor 1 is improved depending on the formation range of the recess portions 35*b* and the region of large current.

In this way, even when the legs 36*a* and 36*b* of the U-shaped block 36, which are the end portions of the magnetic flux generating part, are exposed from the recess portions 35*b*, the inductance value of the reactor 1 is not reduced in the large current range, and since the recess portion 35*b* may be large, the downsizing and weight reduction of the reactor 1 can be achieved.

The reactor 1 of Example 4 and Example 9, in which the ratio of the exposed regions 31*c* and 32*c* is 45%, are prepared. The reactor 1 of Example 4 is the reactor 1 of the first embodiment, and has the joining layer 34 with magnetoresistance arranged adjacent to the exposed regions 31*c* and 32*c* of the end surfaces 31*a* and 32*a*. The reactor 1 of Example 9 is the reactor 1 of the second embodiment, and there is no bonding layer 34 with magnetoresistance arranged adjacent to the exposed portions 31*c* and 32*c* of the end surfaces 31*a* and 32*a*.

Figure 6:
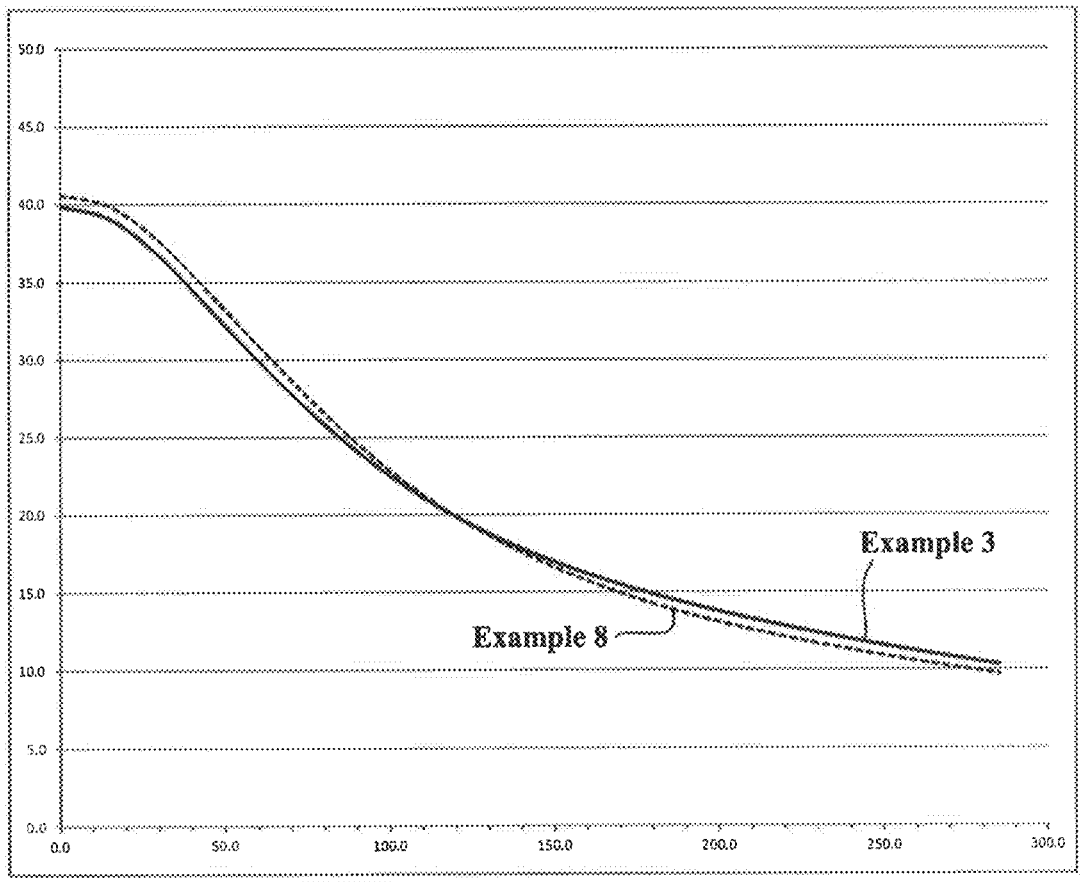
FIG. 6 is a graph illustrating a relationship between current and inductance value of the reactor according to the first embodiment and the second embodiment.

Current from 0 A to 285 A is applied to the reactors of Example 4 and Example 9 by 15 A, and the inductance values are measured. Table 5 shows the relationship between the inductance value and the current measured in the reactor 1 of Example 4 and Example 9. FIG. 6 is a graph illustrating the results of Table 5.

TABLE 5

| | Example 4 | Example 9 |
|---|---|---|
| Presence of Joining Layer | Present | Not Present |
| Ratio of Exposed Region | 45% | 45% |
| Current I(A) | Inductance Value for Each Current | |
| 0.0 | 39.9 | 40.6 |
| 15.0 | 39.1 | 39.9 |
| 30.0 | 36.7 | 37.6 |

TABLE 5-continued

| | Example 4 | Example 9 |
|---|---|---|
| Presence of Joining Layer | Present | Not Present |
| Ratio of Exposed Region | 45% | 45% |
| Current I(A) | Inductance Value for Each Current | |
| 45.0 | 33.3 | 34.3 |
| 60.0 | 29.9 | 30.9 |
| 75.0 | 26.8 | 27.6 |
| 90.0 | 24.1 | 24.6 |
| 105.0 | 21.8 | 22.0 |
| 120.0 | 19.9 | 19.9 |
| 135.0 | 18.3 | 18.1 |
| 150.0 | 16.9 | 16.6 |
| 165.0 | 15.8 | 15.3 |
| 180.0 | 14.9 | 14.2 |
| 195.0 | 14.0 | 13.3 |
| 210.0 | 13.3 | 12.6 |
| 225.0 | 12.6 | 11.9 |
| 240.0 | 12.0 | 11.3 |
| 255.0 | 11.4 | 10.7 |
| 270.0 | 10.8 | 10.2 |
| 285.0 | 10.3 | 9.7 |

As shown in Table 5 and FIG. 6, when comparing the reactor 1 of Example 4 and the reactor 1 of Example 9 for the initial inductance value and the inductance value up to current of 105 A, the inductance value of Example 4 is lower than Example 9. However, in the range in which current is 120 A or more, the inductance value of the reactor 1 of Example 4 is higher than the reactor 1 of Example 9.

Note that, when comparing the reactors 1 of Example 2 and Example 7, in which the ratio of the exposed regions 31*c* and 32*c* is 15%, the inductance value of the reactor 1 of Example 2 is equivalent to that of Example 7 at a current of 240 A, and is higher than that of Example 7 when the current is 255 A or more. When comparing the reactors 1 of Example 3 and Example 8, in which the ratio of the exposed regions 31*c* and 32*c* is 30%, the inductance value of the reactor 1 of Example 3 is equivalent to that of Example 8 at a current of 210 A, and is higher than that of Example 8 when the current is 225 A or more.

When comparing the reactors 1 of Example 5 and Example 10, in which the ratio of the exposed regions 31*c* and 32*c* is 60%, the inductance value of the reactor 1 of Example 5 is higher than that of Example 10 when the current is 105 A or more. When comparing the reactors 1 of Example 6 and Example 11, in which the ratio of the exposed regions 31*c* and 32*c* is 75%, the inductance value of the reactor 1 of Example 6 is higher than that of Example 11 when the current is 75 A or more.

Accordingly, it is observed that by arranging the joining layer 34 with magnetoresistance adjacent to the exposed regions 31*c* and 32*c* of the end surfaces 31*a* and 32*a*, more magnetic flux leaks out from the exposed region 31*c* of the first leg 31 and the exposed region 32*c* of the second leg 32 and enters the recess portions 35*a* the end surface 33*b* of the yoke 33. Therefore, the recess portions 35*a* do not further affect the inductance value in the large current range and can be used as a spacing for installing the fastening member 5, etc. in the reactor 1.

Action and Effect

As described above, the reactor 1 of the present embodiment includes the annular core 3 and the coil 2. The annular core 3 includes legs to which the coil 2 is attached and magnetic flux is generated, such as the first and second legs 31 and 32, or the legs 36*a* and 36*b* of the U-shaped block 36. The annular core 3 includes the pair of yokes 33 which are arranged on both end surfaces of the legs, respectively, and which form a closed magnetic path together with the legs. The recess portions 35*a* or 35*b* are formed at four corners of the annular core 3, and a part of the end surfaces 31*a* and 32*a* of the legs that are the magnetic flux generating parts or the end surfaces of the magnetic flux generating parts are exposed from the recess portions 35*a* or 35*b*. By this, since the effect of the recess portions 35*a* and 35*b* to the inductance value is reduced in the large current range, the downsizing and weight reduction of the reactor 1 can be achieved without reducing the performance of the reactor 1.

Furthermore, the yokes 33 the inner surface 33*a* in the annular core 3 and is connected to the legs by the inner surface 33*a*. The exposed regions 31*c* and 32*c* of the end surfaces 31*a* and 32*a* of the legs exposed from the recess portions 35*a* or 35*b* are in the same plane as the inner surface 33*a* of the yoke 33. By this, there are no more magnetic path inside the annular core 3 for the magnetic flux generated nearby the end surfaces 31*a* and 32*a* to pass through, and the magnetic flux generated nearby the end surfaces 31*a* and 32*a* must once leaks out from the recess portions 35*a* and 35*b*. Therefore, the recess portions 35*a* and 35*b* act efficiently as air gaps.

Typically, in such a reactor 1, the overall length Ly of the yoke 33 along the direction in which the legs line up is shorter than the distance from the end of end surface 31*a* of one of the two legs to the end of the end surface 32*a* of the other of the two legs, including the entire end surfaces 31*a* and 31*b* of the two outermost arranged legs. In addition, in the two outermost legs, a part of the end surfaces 31*a* and 32*a* protrude from the yoke 33.

Then, the recess portions 35*a* and 35*b* are defined by the end surface 33*b* of the yoke 33, and one of the exposed regions 31*c* and 32*c* protruding from the yoke 33 in the exposed regions 31*c* and 32*c* of the end surfaces 31*a* and 32*a* of the two outermost legs. The exposed regions 31*c* and 32*c* in the end surfaces 31*a* and 32*a* of the legs that are exposed from the recess portions 35*a* or 35*b* are on the same plane as the inner surface 33*a* of the yoke 33, except for the joining layer 34.

In the annular core 3, since the yoke 33, the first leg 31, and the second leg 32 form a quadrangular prismatic I-shaped core, the productivity of the reactor 1 is excellent and the production cost thereof can be reduced.

Note that, in the embodiment, although the annular core 3 with two legs is described, the embodiment is not limited thereto, and the annular core 3 with three or more legs may be used. For example, a e-shaped annular core 3, which is two rings in series, with total of three legs, that is, one middle leg and two outer legs arranged in parallel. In the e-shaped annular core 3, the recess portions 35*a* or 35*b* is formed by exposing the end surfaces 31*a* and 32*a* of the two outer legs from the yokes 33. For an annular core 3 with four or more legs, the recess portions 35*a* or 35*b* can be formed by exposing the end surfaces 31*a* and 32*a* of the two outermost legs from the yoke 33.

The fastening member 5 for fastening the reactor body 1*a*, including the annular core 3 and the coil 2, to other components is arranged in the recess portions 35*a* or 35*b*, so that the reactor 1 is downsized. Not only the fastening member 5, but also, for example, other structural components of the reactor 1, external electronic components, electronic circuits, and mechanical elements that are not the reactor 1, and various components of other structures may be placed in the recesses 35*a* or 35*b*.

Furthermore, the end surfaces 31*a* and 32*a* of the two outermost legs and the yoke 33 are joined by a joining layer 34 formed by adhesive. This allows more magnetic flux to leak out from the end surfaces 31*a* and 32*a*, improving the function of the recess portions 35*a* as air gaps. Therefore, the effect of the recess portions 35*a* to the inductance value becomes more reduced in the large current range.

Furthermore, 5 to 30% of the end surfaces 31*a* and 32*a* of the two outermost legs are exposed from the yoke 33. In this case, the inductance value is not reduced in the entire current range compared with the case in which the recess portions 35*a* and 35*b* are not formed. In addition, not only the fastening member 5, but also, for example, other structural components of the reactor 1, external electronic components, electronic circuits, and mechanical elements that are not the reactor 1, and various components of other structures may be placed in the recesses 35*a* or 35*b*, thereby achieving the downsizing and weight reduction of the reactor 1.

Furthermore, 60 to 75% of the end surfaces 31*a* and 32*a* of the two outermost legs are exposed from the yoke 33. By this, when current of 200 A or more is applied, the recess portions 35*a* allows the inductance of the reactor 1 to rather improve, and the downsizing and weight reduction of the reactor 1 can be achieved.

Furthermore, 45 to 75% of the end surfaces 31*a* and 32*a* of the two outermost legs are exposed from the yoke 33. By this, when current of 250 A or more is applied, the recess portions 35*a* allows the inductance of the reactor 1 to rather improve, and the downsizing and weight reduction of the reactor 1 can be achieved.

The present disclosure is not limited to the above embodiments, and also includes other embodiments with similar configurations. The present disclosure also includes combinations of all or any of the above embodiments and other embodiments. Furthermore, various omissions, replacements, and modifications may be made to the embodiments without departing from the scope of claims, and modifications thereof are included in the present disclosure.

REFERENCE SIGN

1: reactor
1*a*: reactor body
2: coil
3: annular core
31: first leg
31*a*: end surface
31*b*: outer side
31*c*: exposed region
31*d*: joined area
31*e*: inner side
32: second leg
32*a*: end surface
32*b*: outer side
32*c*: exposed region
32*d*: joined area
32*e*: inner side
33: yoke
33*a*: inner surface
33*b*: end surface
34: bonding layer
35*a*: recess portion
35*b*: recess portion
36: U-shaped block

36*a*: leg
36*b*: leg
37: leg block
4: core-coating resin
5: fastening member

The invention claimed is:

1. A reactor comprising:

an annular core; and a coil, wherein:

the annular core includes:

two or more legs to which the coil is mounted and which generates magnetic flux;

a pair of yokes which are arranged separately on both end surfaces of the legs and which forms a closed magnetic path together with the legs; and recess portions formed at four corners of the annular core, and a part of the end surfaces of the legs connected to the yoke is exposed from the recess portion.

2. The reactor according to claim 1, wherein:

An inner surface of the yoke forms an inner circumferential surface of the annular core and is connected to the legs, and the part of the end surfaces of the legs exposed from the recess portion may be on a substantially same plane as the inner surface of the yoke.

3. The reactor according to claim 1, wherein:

an overall length of the yoke along a direction in which the legs line up is shorter than a distance from an outermost of the end surface of one of the legs among two outermost legs positioned at an outermost of the annular core to an outermost of the end surface of the other of the legs among the two outermost legs, a part of the end surface of the two outermost legs exposes from an end surface of the yokes, and the recess portions are defined by the end surface of the yokes, and a region of the end surface of the two outermost legs exposing from the yokes.

4. The reactor according to claim 2, wherein:

an overall length of the yoke along a direction in which the legs line up is shorter than a distance from an outermost of the end surface of one of the legs among two outermost legs positioned at an outermost of the annular core to an outermost of the end surface of the other of the legs among the two outermost legs, a part of the end surface of the two outermost legs exposes from an end surface of the yokes, and the recess portions is defined by the end surface of the yokes, and a region of the end surface of the two outermost legs exposing from the yokes.

5. The reactor according to claim 1, further comprising:

a main body comprising the annular core and the coil, and a fastening member which is arranged in the recess portion and which fasten the main body to other portions.

6. The reactor according to claim 1, further comprising a joining layer which is formed by adhesive and which joins the end surface of the two outermost legs, and the yokes.

7. The reactor according to claim 6, wherein 5 to 30% of the end surface of the two outermost legs is exposed from the yokes.

8. The reactor according to claim 6, wherein:

current of 200 A or more is applied, and 60 to 75% of the end surface of the two outermost legs is exposed from the yokes.

9. The reactor according to claim 6, wherein:

current of 250 A or more is applied, and 45 to 75% of the end surface of the two outermost legs is exposed from the yokes.

10. The reactor according to claim 4, further comprising a core-coating resin covering the annular core, wherein the fastening member is formed on the core-coating resin.

* * * * *